United States Patent [19]

Scharf

[11] Patent Number: 4,691,403

[45] Date of Patent: Sep. 8, 1987

[54] COMBINATION BASE BOARD/CORNER & FLOOR BRUSH HOLDER

[76] Inventor: Stephen Scharf, 54 Farmington La., Melville, N.Y. 11747

[21] Appl. No.: 847,667

[22] Filed: Apr. 3, 1986

Related U.S. Application Data

[63] Continuation-in-part of Ser. No. 767,828, Aug. 21, 1985, abandoned.

[51] Int. Cl.[4] ..... A46B 13/02

[52] U.S. Cl. ..... 15/114; 15/4; 15/49 C; 15/98; 15/230.17; 15/DIG. 5; 15/183

[58] Field of Search ..... 15/230.17, 230.14, 230.16, 15/180, 105, 114, 183, DIG. 5, 4, 49 C, 98

[56] References Cited

U.S. PATENT DOCUMENTS 2,450,679 10/1948 May ..... 15/183 X
3,302,232 2/1967 Wasiloff et al. ..... 15/230.17
3,357,141 12/1967 Annis, Jr. ..... 15/230.14 X
3,412,417 11/1968 Ahern et al. ..... 15/183
3,795,933 3/1974 Sevfert ..... 15/114

FOREIGN PATENT DOCUMENTS 1321081 6/1973 United Kingdom ..... 15/DIG. 5

*Primary Examiner*—Peter Feldman
*Attorney, Agent, or Firm*—Richard L. Miller

[57] ABSTRACT

A combination base board/corner and floor brush holder is provided for simultaneously cleaning or polishing the base boards and floor. The device consists of a circular pad for removable attachment to bottom of the holder for use on a floor and a plurality of brushes for removable attachment around perimeter of the holder for use on a base board of a wall. A flexible cover is removably attached over the holder to keep the brushes in proper position when the holder rotates when used. A longer softer brush may be installed so that bristle will reach to a corner apex between wall at right angles to each other.

7 Claims, 4 Drawing Figures

COMBINATION BASE BOARD/CORNER & FLOOR BRUSH HOLDER

BACKGROUND OF THE INVENTION

This Application is a continuation in part of application Ser. No. 06/767,828, filed on Aug. 21, 1985, now abandoned.

The instant invention relates generally to floor polishing machines and more specifically it relates to a combination base board/corner and floor brush holder.

SUMMARY OF THE INVENTION

A principle object of the present invention is to provide a combination base board/corner and floor brush holder that can be attached to the standard floor polishing machine so that the floor, base boards, and corners can be cleaned and polished together simultaneously.

Another object is to provide a combination base board/corner and floor brush holder that has a plurality of removable brushes around the perimeter of the holder for use on the base boards, in which each brush can be replaced when needed.

An additional object is to provide a combination base board/corner and floor brush holder that has hook and loop pile type removable pad on the bottom of the holder for use on the floor in which the pad can be replaced when needed.

A further object is to provide a combination base board/corner and floor brush holder that is economical in cost to manufacture.

A still further object id to provide a combination base board/corner and floor brush holder that is simple and easy to use.

A yet still further object id to provide a combination base board/corner and floor brush holder that permit the base board to be cleaned and polished right to the very apex of a corner between to adjacent right angle walls.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DESCRIPTION OF THE PREFERRED EMBODIMENT

Figure 1:
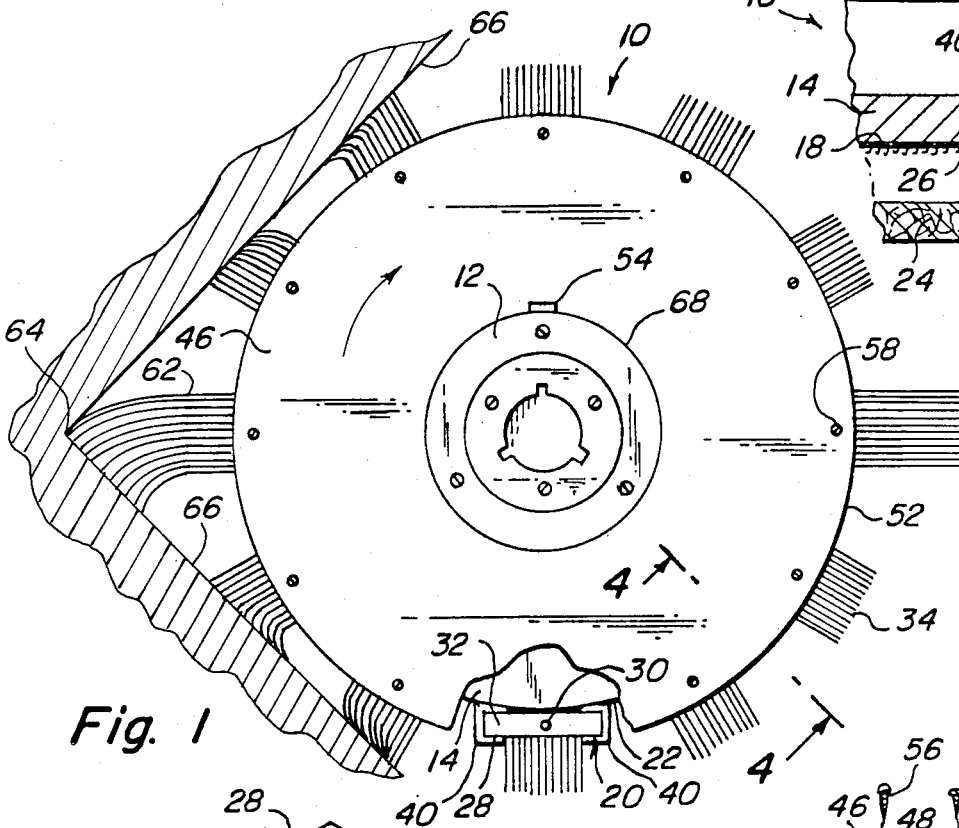
FIG. 1 is a top plan view of the invention, with parts broken away to illustrate construction details thereof, and showing how the instant invention can reach into the apex between two adjacent walls at right angles to each other.
Figure 4:
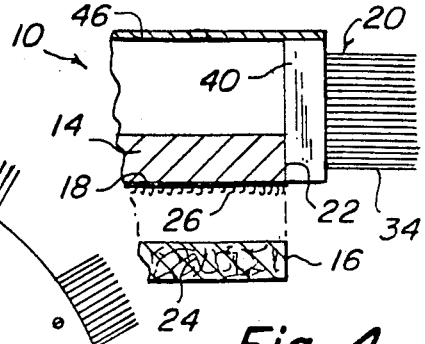
FIG. 4 is a cross sectional view partly exploded taken along line 4—4 in FIG. 1.
Figure 3:
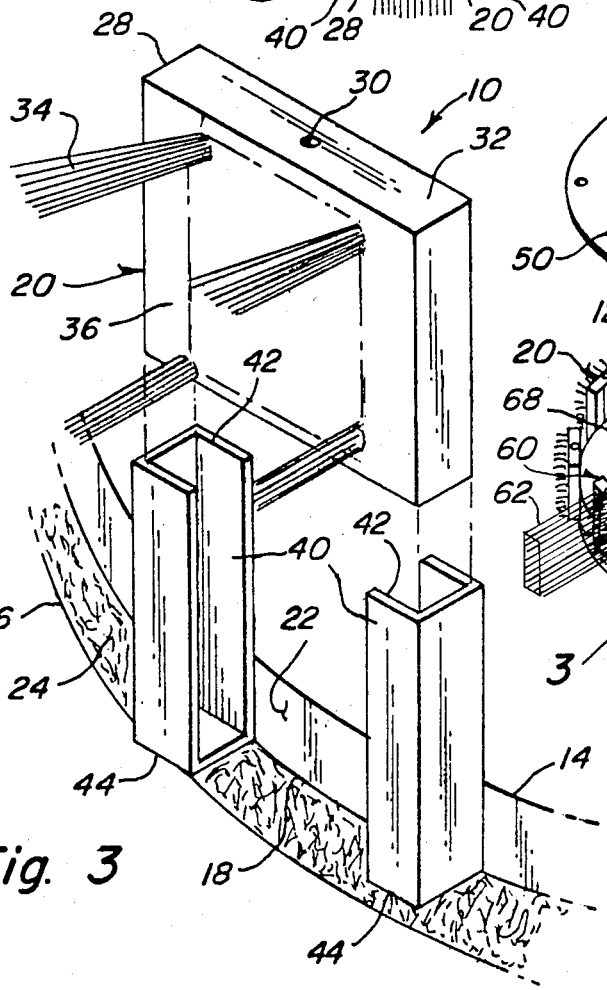
FIG. 3 is an enlarged partial perspective exploded view, as indicated by number 3 in FIG. 2, of one of the brushes removed from its holder.
Figure 2:
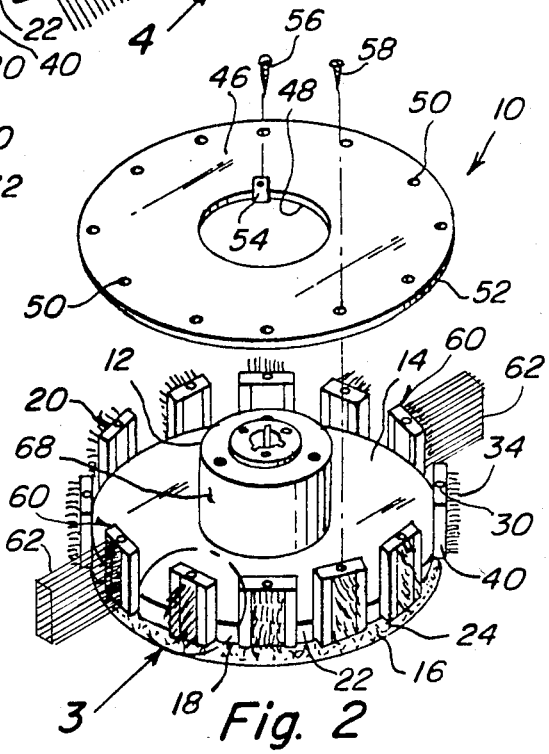
FIG. 2 is a partial perspective exploded view of the invention.

Turning now descriptively to the drawings, in which similar reference characters denote similar elements throughout the several views, FIGS. 1 through 4 illustrate a combination base board/corner and floor brush holder 10 for a floor polishing machine (not shown).

The holder 10 consists of a hub 12 that has a circular base flange 14 wherein the hub is removably attached to the floor polishing machine for rotation thereby. A circular pad 16 is for removable attachment to bottom 18 of the circular base flange 14 for use on the floor (not shown). The circular pad 16 can be replaced when needed. A plurality of brushes 20 is for removable attachment around perimeter 22 of the circular base flange 14 for use on a base board of a wall (not shown). Each of the brushes 20 can be replaced when needed.

The circular pad 16 is fabricated out of loop pile material 24. Hook pile 26 is formed on the bottom 18 of the circular base flange 14 so that the circular pad 16 can be removably attached thereto.

Each of the brushes 20 includes a back plate 28 that has a hole 30 on one end 32. A plurality of bristles 34 are mounted on one side 36 of the back plate 28.

The brushes 20 are removably attached by a plurality of paired spread channel track members 40, 40. Each of the channel track members 40 has an open end 42 and a closed end 44. When the pair is mounted vertically to the perimeter 22 of the circular base flange 14 the open ends 42 will be on top. The back plate 28 of each of the brushes 20 will fit within each pair of the channel track members 40, 40 with the hole 30 on top and bristles 34 extending outwardly therefrom (see FIG. 3).

Pairs of brushes 60 may be installed with long soft bristles 62 so that so that these bristles will whip into a corner apex 64 typically between to wall 66 which are at right angles to each other, as best seen in FIG. 1. This whip action permits the base board to be cleaned and/or polished as desired right to the corner apex without interfering with the normal cleaning and polishing action that is simultaneously being accomplished along the straight sections of base board. Naturally the proper selection of bristle softness and length is required if these two simultaneous actions are two take place efficiently and smoothly at the same time.

A circular flexible cover 46 is also provided and has a central aperture 48 and a plurality of holes 50 around its perimeter 52 for removable attachments over the hub 12 and the brushes 20.

At least one angle bracket 54 is affixed to the cover 46 within the central aperture 48. A screw 56 is used for removably attaching the angle bracket 54 to side 68 of the hub thus removably attaching the cover 46 to the hub 12.

A plurality of screws 58 are for removably attaching the cover 46 to the brushes 20. Each of the screws 58 enters one of the holes 50 in the cover 46 and hole 30 in the back plate 28 of one of the brushes 20. If any of the brushes 20 hits a solid object the cover 46 will prevent the back plate 28 from sliding up and leaving the channel track members 40, 40.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A combination base board/corner and floor brush holder for a floor polishing machine which comprises;

(a) a hub having a circular base flange wherein said hub is removably attachable to said floor polishing machine for rotating thereby;

(b) a circular pad for removable attachment to bottom of said circular base flange for use on a floor;

(c) means for removably attaching said circular pad to said bottom of said circular base flange in which said circular pad can be replaced when needed;

(d) a plurality of brushes for removable attachment around perimeter of said circular base flange for use on a base board of a wall;

(e) means for removably attaching said brushes to said perimeter of said circular base flange in which each said brush can be replaced when required; and (f) means for polishing base boards to a corner apex between two walls which are at right angles to each other, which include at least a single brush with longer and softer bristles than said plurality of brushes where by said longer and softer bristles whip into the corner between said two walls and thereby polish said base board to said apex.

2. A combination base board/corner and floor brush holder as recited in claim 1 wherein said pad removably attaching means includes:

(a) said circular pad fabricated out of loop pile material; and (b) hook pile formed on said bottom of said circular base flange so that said circular pad can be removably attached thereto.

3. A combination base board/corner and floor brush holder as recited in claim 2 wherein each of said brushes includes a back plate having a hole on one end and a plurality of bristles mounted on one side of said back plate.

4. A combination base board/corner and floor brush holder as recited in claim 3 wherein said brushes removably attaching means includes a plurality of paired spread channel track members, each of said track members having an open end and a closed end so that when said pair are mounted vertically to said perimeter of said circular base flange said open ends will be on top in which said back plate of each of said brushes will fit within each pair of said channel track members with said hole on top end extending outwardly therefrom.

5. A combination base board/corner and floor brush holder as recited in claim 4 further comprising:

(a) a circular flexible cover having a central aperture and a plurality of holes around its perimeter for removable attachment over said hub and said brushes;

(b) means for removably attaching said cover to said hub; and (c) means for removably attaching said cover to said brushes through each said hole of each said back plate so that if any of said brushes hits a solid object said cover will prevent said back plate from sliding up and leaving said channel track members.

6. A combination base board/corner and floor brush holder as recited in claim 5 wherein said means for removably attaching said cover to said hub includes:

(a) at least one angle bracket affixed to said cover within said central aperture; and (b) a screw for removably attaching said angle bracket to side of said hub.

7. A combination base board/corner and floor brush holder as recited in claim 6 wherein said means for removably attaching said cover to said brushes are a plurality of screws, each of which enters one of said holes in said cover and hole in said back plate of one of said brushes.

* * * * *